US006333718B1

(12) United States Patent
Poncel et al.

(10) Patent No.: US 6,333,718 B1
(45) Date of Patent: Dec. 25, 2001

(54) CONTINUOUS MULTI-SATELLITE TRACKING

(75) Inventors: Yves Poncel, Marly le Roi; Philippe Freyssinier, Noisy le Roi, both of (FR)

(73) Assignee: Dassault Electronique, Saint Cloud (FR)

( * ) Notice: Subject to any disclaimer, the term of this patent is extended or adjusted under 35 U.S.C. 154(b) by 0 days.

(21) Appl. No.: 09/201,656

(22) Filed: Dec. 1, 1998

(51) Int. Cl.[7] ..... H01Q 3/14; H01Q 19/06

(52) U.S. Cl. ..... 343/753; 343/766; 343/911 L

(58) Field of Search ..... 343/765, 766, 343/882, 753, 911 L; H01Q 3/04, 3/08, 19/06, 3/14

(56) References Cited

U.S. PATENT DOCUMENTS

| | | | | |
|---|---|---|---|---|
| 4,531,129 | | 7/1985 | Bonebright et al. | 343/754 |
| 5,227,806 | * | 7/1993 | Eguchi | 343/765 |
| 5,703,603 | * | 12/1997 | Korzhenkov et al. | 343/882 |

FOREIGN PATENT DOCUMENTS

| | | |
|---|---|---|
| 15 16 845 A | 7/1969 | (DE) . |
| 0 707 356 A | 4/1996 | (EP) . |
| WO 93 024286 A | 2/1993 | (WO) . |
| WO 96 02953 A | 2/1996 | (WO) . |

OTHER PUBLICATIONS

Johnson C M: Millimeter Wave Search System: IBM Technical Disclosure Bulletin, vol. 5, No. 8, Janvier 1963, pp. 105–106, XP002069180 See entire document.

* cited by examiner

*Primary Examiner*—Michael C. Wimer
(74) *Attorney, Agent, or Firm*—Nixon & Vanderhye P.C.

(57) ABSTRACT

The pointing of at least two sensors (61, 62) is ensured through a Luneberg lens (50). A first frame (20) pivoting on a support (10), supports in pivoting manner a second frame (30), which can in turn support the lens (50). The second frame (30, 40) supports at least one rail (41) for guiding the sensors in the vicinity of the focal surface of the lens. Control means (90) act on the mount as a function of data concerning the position of satellites to be sighted. They are arranged so as to temporarily stop the sighting of one of the satellites, bring the mount into an opposite position on the focal surface, whilst continually sighting the other satellite, and resume the sighting of both satellites, the two sensors then being in an inverted position on the rail.

12 Claims, 3 Drawing Sheets

CONTINUOUS MULTI-SATELLITE TRACKING

BACKGROUND OF THE INVENTION

1. Field of the Invention

The invention relates to the tracking of satellites, particularly from earth.

2. Discussion of the Prior Art

The importance of satellite communications is already known and will increase in the future. Apart from the presently used geostationary satellites, it is also intended to launch constellations of nonsynchronous satellites, for broadband, high speed telecommunications applications.

It is naturally also necessary to provide ground stations able to track several of these satellites at the same time. The basic procedures to be used are known and are already used in professional electronics. However, difficulties to which reference will be made hereinafter are encountered in the case of the constraining requirements of cost and/or overall dimensions (weight and volume), as is the case in general public electronics.

SUMMARY OF THE INVENTION

The present invention aims at improving this situation.

It is based on an electromagnetic, multi-satellite reception device comprising at least two sensors and means for pointing said sensors at the respective, separate satellites.

According to a first aspect of the invention, the pointing means comprise an electromagnetic lens having a substantially continuous, focal surface, at least for a substantial part of the celestial half-space. To it is added a mount able to individually position these sensors in the immediate vicinity of said focal surface, substantially at any useful point thereof, and in selectively controlled manner. The mount control means act as a function of data available concerning the position of the satellites to be sighted.

Preferably, the electromagnetic lens has a symmetry of revolution, particularly a spherical symmetry, as is the case for the Luneberg lens. Advantageously, the mount is then capable of at least two degrees of freedom of rotation for each of the sensors.

According to another aspect of the invention, the mount has a rotary element common to both sensors and capable of at least one of the degrees of freedom in rotation. In a special embodiment, said rotary element comprises a first frame pivoting on a support and a second frame pivoting on the first frame. In turn, the second frame supports at least one guidance means for the sensors, particularly by rail. In addition, said second frame can support the electromagnetic lens. As the electromagnetic lens has a symmetry of revolution, the rail can cover a circular arc, extending to a semicircle.

According to another aspect of the invention, the control means are arranged so as to temporarily stop the sighting of one of the satellites by one of the sensors. The other sensor continues to sight the other satellite, but said other sensor is jointly displaced on the rail and on the mount until the latter is brought into an opposite position on the focal surface (pivoting of 180° for a semicircular rail). The two sensors then appear in a reverse order on the rail ad it is possible to resume the sighting of both satellites in the new sensor configuration, without having at any time lost contact with one of them.

BRIEF DESCRIPTION OF THE DRAWINGS

Other features and advantages of the invention can be gathered from the following description relative to the attached drawings, wherein show.

DETAILED DISCUSSION OF THE PREFERRED EMBODIMENTS

The attached drawings are to scale and of a specific nature. Thus, not only can they be used to facilitate understanding of the following detailed description, but can also contribute to the definition of the invention, when appropriate.

Figure 1:
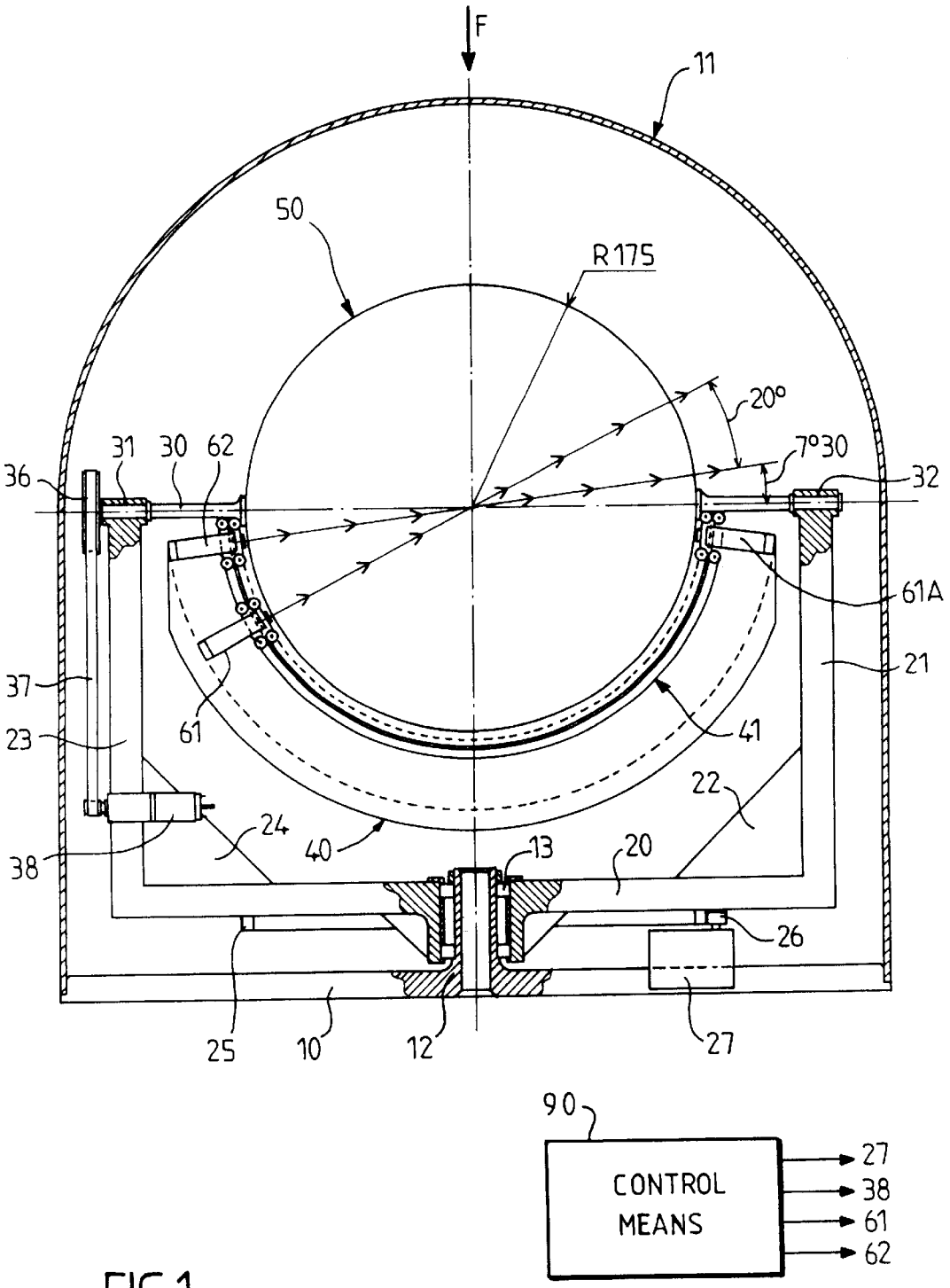
FIG. 1 A view in elevation and part section of a device according to a preferred embodiment of the invention.

In FIG. 1, the device has a support 10, which supports a radome 11, whereof the base is generally cylindrical and the upper part is a spherical halfdome. In the centre, the support 10 carries a hollow shaft 12, about which is mounted a ball bearing 13, which supports a generally U-shaped frame 20, whereof the ends of the branches support bearings 31 and 32. Reinforcing ribs 22 and 24 are provided between the branches of the U. Similar, not referenced ribs are provided about the axis in the frame 20, whilst the lower part thereof is provided with a ring gear 25, which cooperates with the roller 26 of a drive motor 27 mounted on the support 10.

The bearings 31 and 32 support two half-shafts 30, rendered integral with a sphere 50, along one of its large diameters. In known manner, said sphere 50 is preferably in Luneberg lens form.

The half-shafts 30 support a rib 40, which in turn carries a rail 41, in which slide two sensor means 61 and 62, in the manner to be described hereinafter.

A possible position of the two sensors 61 and 62 is that shown to the left in the drawing, where the angle between the two sensors is approximately 20°. The drawing also shows that the limit excursion of the sensor 62 is 7°30 of the half-shafts 30, in the embodiment described and taking account of the dimensions.

Figure 2:
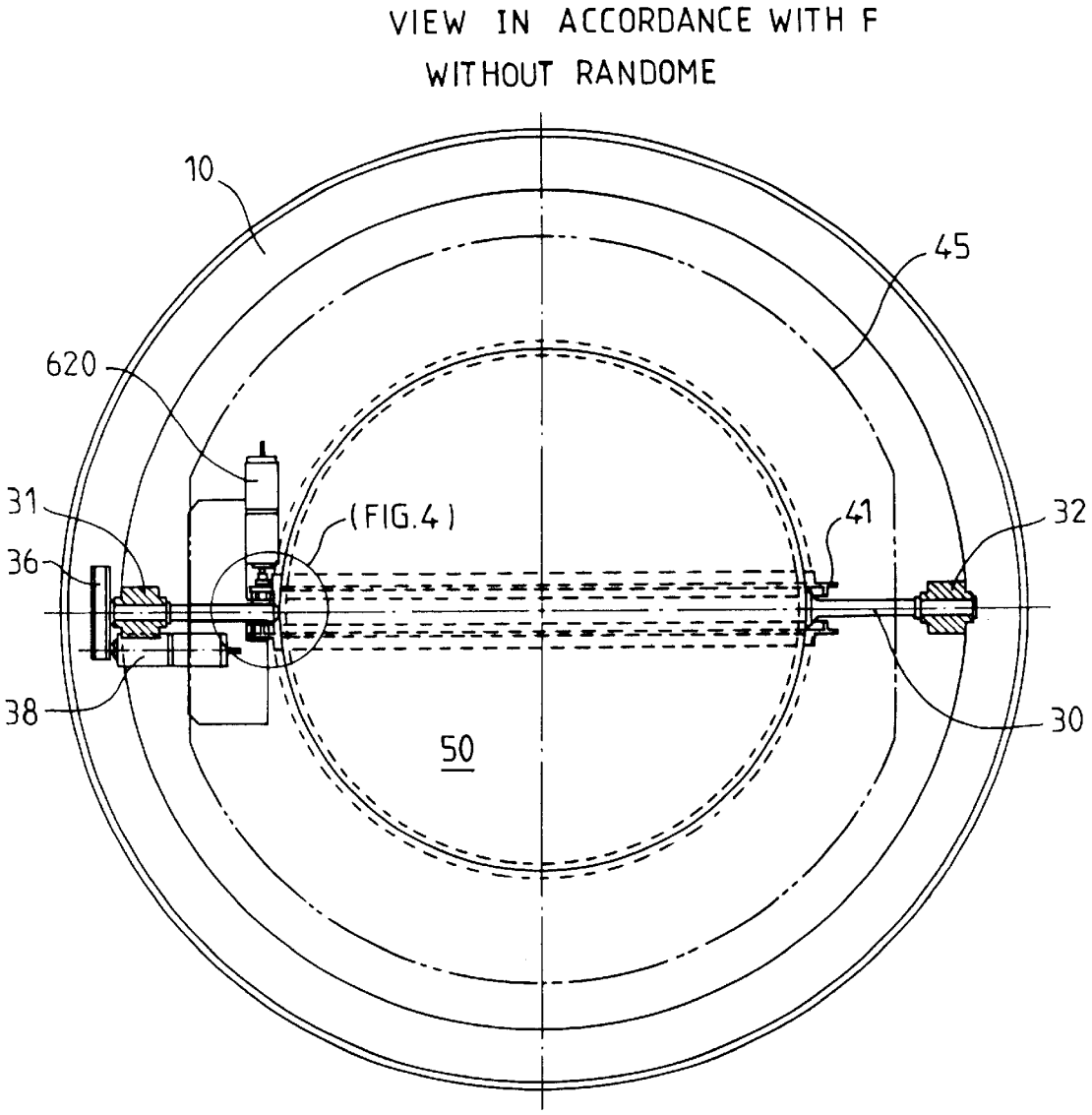
FIG. 2 A plan view of the device of FIG. 1 with the radome removed.

The same members are shown in FIG. 2, particularly the motor 38 and, in a more specific view, the element associated with the motor 620 of the sensor 62, which will displace it together therewith on the rail. The axis line 45 in FIG. 2 also shows the two limit positions of the rib 40 supporting the rail 41.

Figure 3:
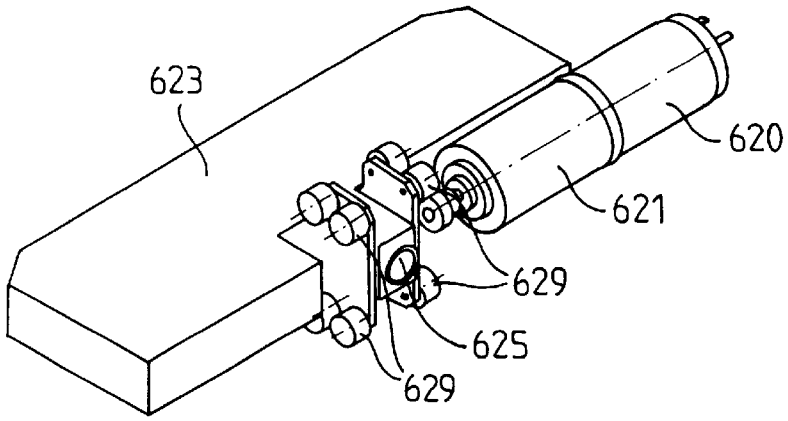
FIG. 3 A perspective view showing a detail of the device of FIG. 2

The element in question is illustrated in FIG. 3. It has a mobile plate 623, which supports a motor 620 having a reduction gear 621, which e.g. engages on a rack carried by the rail 41 on which roll eight rollers 629. This roller means surrounds the actual sensor 625, which is e.g. a conical, microwave frequency horn, operating in circular polarization, or any other sensor compatible with the nature of the wave on which the link operates.

Figure 4:
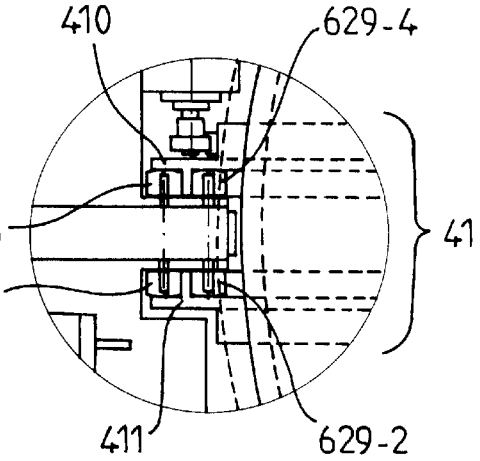
FIG. 4 A partial view showing another detail of the device of FIG. 2.

FIG. 4 shows how the pairs of rollers 629 cooperate with the rail, which in this embodiment is constituted by two T-sections, whose webs face one another on the same axis, said members carrying the references 410 and 411. It can e.g. be seen that the rollers 629-1 and 629-2 engage on the web of section 411 and the same applies with respect to rollers 629-3 and 629-4 with the web 410. The broken lines towards the bottom of FIG. 4 illustrate the general profile of the rail.

Figure 5:
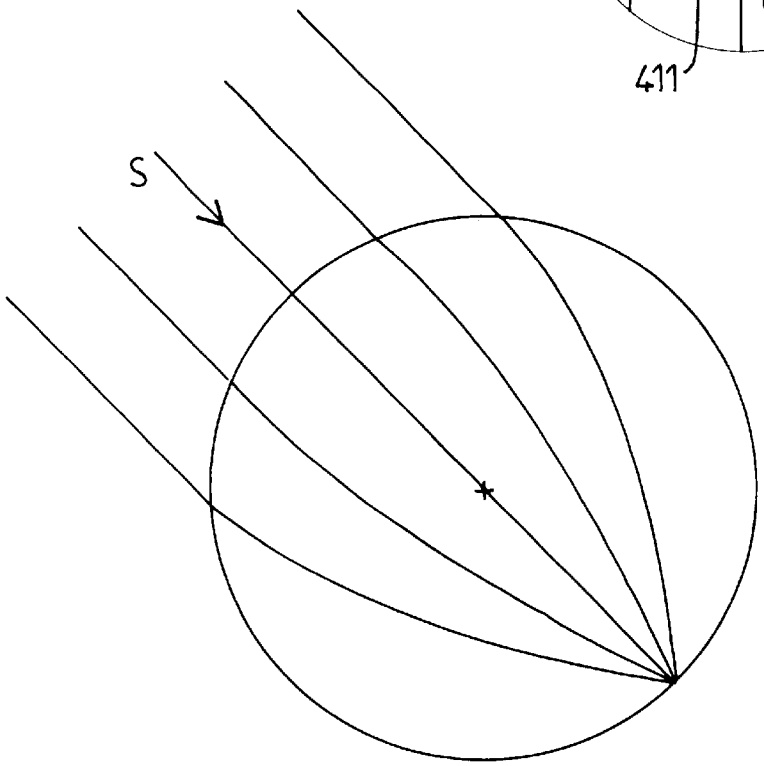
FIG. 5 Diagrammatically the operation of a Luneberg Lens.

As has already been indicated, the sphere 50 is in electromagnetic Luneberg lens form, although this example is not limitative. Through an appropriate graded index of the material constituting the lens, a parallel beam striking the upper face (sky side) of the lens converges (by inwardly curved rays) towards the point diametrically opposite to the point of tangency of the perpendicular to said beam on the sphere (FIG. 5). A microwave frequency horn maintained in the vicinity of said diametrically opposite point will therefore pick up the radiation coming from the satellite located in the direction of the axis S in FIG. 5 with a good signal-to-noise ratio.

As the electromagnetic lens is a spherical Luneberg lens, the element has three degrees of freedom in rotation permitting, with the aid of a sensor, to tract z satellite in controlled manner at substantially any point of the celestial half-space.

At a certain angular distance on the rail, it is possible to provide another sensor, which is then able to track another satellite differing from the first.

This arrangement can have numerous applications in the satellite tracking field, no matter whether said satellites are geostationary or not.

It has a particular advantage in the case of nonsynchronous satellites forming part of a constellation, in the manner stated hereinbefore. These satellites are redundant, i.e. two of the satellites supply the same data traffic. As a general rule, it is necessary to track at least two satellites, in order to maintain continuity of service if one of the satellites fails and in particular so as to be ready to switch to the other satellite when one of the satellites tracked is lost from view disappearing over the horizon.

The invention firstly satisfies the requirement of making it possible to track two satellites at the same time. It is always possible to find on the Luneberg lens a diametrical plane passing through two sighting lines. By placing the semicircular rail in said diametrical plane, with the aid of two motors 27 and 38, it is merely necessary to finely adjust the angular position of the diametrical plane and the position of the sensors 61 and 62 on the rail. In principle, the satellite trajectory law is known and it is possible to draw therefrom control angles for the motors 27, 38, 610 and 620. However, it would also be possible to use picked up signals in order to control the position of the mount/sensor(s) assembly.

However, one of the problems encountered with nonsynchronous satellites is that their sighting directions can cross.

Apart from the physical impossibility of placing at the same point two sensors sighting different directions, account must also be taken of the non-negligible overall dimensions of said sensors and their ancillary members, both of an electronic and mechanical nature.

It is possible to cope with these situations by providing two physically separate and completely different sighting systems, but this solution is much too onerous and heavy for most applications.

The applicant has used as a basis the case of at least two satellites supplying the same data, or at least comparable data. Thus, two satellites are tracked, whereas interest is only attached to the data coming from one of them up to the time that this disappears or fails. Use is then made of the data of the second satellite and a third satellite is sought as the standby satellite. Thus, the tracking operation is adapted to the path of the constellation of considered satellites.

In order to limit costs and dimensions, both as regards weight and volume, it is highly desirable to only use a single device for receiving the at least two satellites at the same time.

The same problem can more simply arise when, without the sighting directions of the satellites crossing, they are sufficiently close together for multi-satellite sighting to be impossible, bearing in mind the arrangement and dimensions of the ancillary devices.

Therefore the applicant has designed the arrangement described and which is in accordance with the preferred embodiment. Thus, if it is necessary to track two satellites, only the signals of one of them are used at a given moment, so that it becomes possible to carry out an inversion of the sensors in the following way. When the two satellites are sufficiently spaced apart, the two sensors 61 and 62 are in each case pointed towards one of the satellites. When the two satellites approach one another to the extent that it is impossible to pick them up simultaneously, bearing in mind the physical dimensions of the sensor and its ancillary devices, according to the invention tracking is continued with only one of the sensors, e.g. sensor 61 here. The movement of the sensors on the rail, the rotation of the half-shafts 30 and that of the frame 20 are then jointly controlled in order to continue the tracking of said satellite by the sensor 61, whilst passing said sensor 61 to the other end of the rail or more specifically into a symmetrical position, with respect to the vertical, of the position which it had at the start.

The sensor 61 approaches the bearing 32, whilst being kept pointed on the satellite by rotations about the pivot 12 and the bearings 30 and 32.

At the end of the movement, the bearing 32 is at the position previously occupied by the bearing 30 and the bearing 30 is at the position of bearing 32. The sensor 61 close to the bearing 32 occupies the geometrical position previously occupied by the sensor 62. The drawing is the same, but with an apparent inversion of the positions of the sensors.

After this movement, it is the sensor 61 which is closest to the bearing 32 and the sensor 62, which was initially located between the half-shafts 30 and the sensor 61, is now located on the other side of the sensor 61. In other words, it is now the sensor 61 which will be placed between the half-shaft 30 and the sensor 62, but at the other end of the rail.

As soon as the crossing of the two satellites is ended, it is possible to resume the tracking of both satellites with the taco sensors and continue the operation in the desired way.

Thus, the invention also provides an elegant solution to the problem of the taking of turns between nonsynchronous satellites of a constellation e.g. used for telecommunications purposes. It also makes it possible to minimize the time during which the ground station only receives one of the two satellites, when a redundancy of the link is required.

The applicant has found that this inversion of the two sensors using the embodiment described can take place in a relatively short time of typically 1 to 5 seconds. This makes it possible to ensure the tracking of two satellites, without losing contact with one of them, and with a very brief contact loss for the other. The invention is then particularly suitable for dealing with a more specific problem consisting of ensuring, e.g. for broadband, high speed telecommunications applications, the link with nonsynchronous satellites forming part of a constellation devoted to this particular application.

However the invention is not solely intended for this particular application.

In what has been described up to now, it is necessary for the rail 41 (and, if provided, its rib 40) to be integral with the half-shafts 30. It has also been stated that the sphere 50 is integral with the half-shafts 30. This constitutes a simple and advantageous way of fixing and positioning the sphere with respect to the mount and the rail, but said latter characteristic is not obligatory and it would be possible to suspend the sphere. 50 within the system using other means. It should also be noted that the upper spherical dome of the radome 11 is coaxial to the sphere 50.

In the embodiment described, the rail covers a complete hemisphere It is clear that for certain applications the rail will only cover an arc of the surface of the sphere. This arc is not necessarily contained in a diametrical planes The same sphere could also be equipped with several arcs of this type, e.g. installed with a certain mutual angle and this angle could even vary.

The invention is also very advantageous in connection with the Luneberg lens due to its spherical symmetry and the fact that the focal surface thereof is a spherical half-dome (for the celestial half-space and more specifically greater). However, the invention could also be implemented with other electromagnetic lens types having a focal surface of the same nature, particularly but not exclusively a three-dimensional focal surface.

More generally, the mount used for the support of the sensor or sensors according to the invention is capable of three degrees of freedom in rotation, It would obviously also be possible to use mount variants having the same characteristics.

Moreover, in the preferred variant described for the tracking of two satellites with inversion of the element, said variant is of interest not only for the strict crossing of two satellites, but also when they are sufficiently close together to make it impossible for the sensors to be juxtaposed, which can arise in situations other than a strict crossing.

The invention could also be used in the case of sighting two geostationary satellites and on changing at least one of said two satellites with, as hereinbefore, a physical impossibility due to the volume around the sensors.

In this connection it should be noted that the space-consuming arrangement around the sensor is installed here perpendicular to the plane of the rail. A variant could consist of making said arrangement mobile in order to facilitate the proximity of sensors in different positions on the focal surface of the lens.

Preferably, the sensor horn is accompanied by a microwave frequency amplifier. The microwave frequency link and the supply of the amplifier can e.g. accompany the sensor on the rail, in the manner of a caterpillar, in order rejoin one of the half-shafts 30 and then descend along half the frame in order to traverse the hollow shaft 12

In place of the caterpillar, it would also be possible to have on the rail a slotted waveguide, more particularly with a rectangular shape, which permits by an appropriate multiplexing the transmission of signals detected by the two sensors at the ends of the rail and after which they resume the axis, e.g. as hereinbefore. Other variants can be envisaged for the transmission of signals picked up, which could extend to an optical link starting form the sensor and directionally controlled in order to reach another point of the arrangement.

What is claimed is:

1. Electromagnetic multi-satellite reception device comprising:

at least two sensors; and means for pointing said sensors towards respective, separate satellites wherein the pointing means comprises:

an electromagnetic lens having a substantially continuous focal surface, at least for a substantial part of a celestial half-space, and a mount slidably mounting said at least two sensors on a rail for movement relative to each other, said rail independently, separately and individually positioning said sensors adjacent said focal surface at substantially any useful point thereof, and means for the control of the mount and the position of each of said sensors relative to another of said sensors as a function of position data for the satellites.

2. Device according to claim 1, wherein the electromagnetic lens is a Luneberg lens.

3. Device according to claim 1, characterized in that the mount is capable of three degrees of freedom of rotation for each of the sensors.

4. Device according to claim 3, characterized in that the mount has a rotary element common to both sensors, capable of at least one of the degrees of freedom in rotation.

5. Device according to claim 4, wherein said rotary element comprises a first frame pivoting on a support and a second frame pivoting on the first frame.

6. Device according to claim 5, characterized in that the second frame supports the electromagnetic lens.

7. Device according to claim 5, characterized in that the second frame support sais rail for guiding the sensors.

8. Device according to claim 7, characterized in that, as the electromagnetic lens has a symmetry of revolution, the rail covers a circular arc.

9. Device according to claim 8, characterized in that the rail covers a semicircle.

10. Device according to claim 1, wherein the control means are arranged so as to temporarily stop the sighting of one of the satellites, bring the mount into an opposite position on the focal surface, whilst continually sighting the other satellite, and resume the sighting of the two satellites with the two sensors then in an inverted position on the rail.

11. Electromagnetic multi-satellite reception device comprising:

at least two sensors;

pointer for pointing said sensors towards respective, separate satellites, wherein the pointer comprises:

an electromagnetic lens having a substantially continuous focal surface, at least for a substantial part of a celestial half-space, and a mount slidably mounting said sensors on a rail for movement relative to each other, said rail separately, independently and individually positioning said sensors adjacent said focal surface at substantially any useful point thereof, and a mount controller, responsive to satellite position data, for moving the mount and the position of each of said sensors relative to another of said sensors to enable the satellites to be tracked by said at least two sensors.

12. Electromagnetic multi-satellite reception device comprising:

at least two sensors; and means for pointing said sensors towards respective, separate satellites, wherein the pointing means comprises:

an electromagnetic lens having a substantially continuous focal surface, at least for a substantial part of a celestial half-space, and a mount slidably mounting said at least two sensors on a rail for movement relative to each other, said mount providing three degrees of freedom rotation for each of said sensors, with said rail separately, individually and independently positioning said sensors adjacent said focal surface at substantially any useful point thereof, and means for the control of the mount and the position of each of said sensors relative to another of said sensors as a function of position data for the satellites.

* * * * *